US011001277B2

(12) United States Patent
Cartier et al.

(10) Patent No.: US 11,001,277 B2
(45) Date of Patent: May 11, 2021

(54) DOOR ACTUATORS, INTEGRATED DOOR ACTUATOR AND METHOD OF OPERATING A DOOR ACTUATOR OF A TRANSIT VEHICLE

(71) Applicant: TECHNOLOGIES LANKA INC., La Pocatiere (CA)

(72) Inventors: Paul Cartier, Saint-Anne-de-la-Pocatiere (CA); Jean-Paul Dionne, Levis (CA); Xavier Douville, La Pocatiere (CA); Eric Dube, Saint-Bruno-de-Kamouraska (CA)

(73) Assignee: TECHNOLOGIES LANKA INC., Quebec (CA)

( * ) Notice: Subject to any disclaimer, the term of this patent is extended or adjusted under 35 U.S.C. 154(b) by 196 days.

(21) Appl. No.: 16/072,332

(22) PCT Filed: Feb. 1, 2017

(86) PCT No.: PCT/CA2017/050113

§ 371 (c)(1),
(2) Date: Jul. 24, 2018

(87) PCT Pub. No.: WO2017/132762

PCT Pub. Date: Aug. 10, 2017

(65) Prior Publication Data

US 2019/0031211 A1 Jan. 31, 2019

Related U.S. Application Data

(60) Provisional application No. 62/289,830, filed on Feb. 1, 2016, provisional application No. 62/342,522, filed on May 27, 2016.

(51) Int. Cl.
*B61D 19/02* (2006.01)
*E05F 15/60* (2015.01)
(Continued)

(52) U.S. Cl.
CPC ..... *B61D 19/005* (2013.01); *B61D 19/02* (2013.01); *E05D 15/0634* (2013.01);
(Continued)

(58) Field of Classification Search
CPC ..... E05F 15/60; E05D 15/063; E05D 2015/0695; E05D 2015/0652;
(Continued)

(56) References Cited

U.S. PATENT DOCUMENTS 3,442,051 A * 5/1969 Johnson ..... F16C 39/063 49/414
4,698,876 A * 10/1987 Karita ..... E05D 15/06 16/102

(Continued)

FOREIGN PATENT DOCUMENTS

CA 2548861 A1 11/2007
CN 1641180 A 7/2005

(Continued)

OTHER PUBLICATIONS

International Search Report dated Mar. 8, 2017 of the corresponding International Application PCT/CA17/050113 filed Feb. 1, 2017.

*Primary Examiner* — Justin B Rephann
(74) *Attorney, Agent, or Firm* — Norton Rose Fulbright US LLP; Gerard Messina

(57) ABSTRACT

The door actuator generally has a receiving structure having a door carriage path; a first coil assembly and a second coil assembly both being mounted to the receiving structure along a common coil assembly plane and being longitudinally spaced from one another along the door carriage path by a spacing distance; and a door carriage being slidingly received by the receiving structure, the door carriage having a plurality of alternate-pole magnets provided along a magnet plane being parallel and spaced apart from the coil
(Continued)

assembly plane, the first and second coil assemblies being operable to move the door carriage back and forth between the two ends of the rail.

16 Claims, 10 Drawing Sheets

(51) Int. Cl.
*B61D 19/00* (2006.01)
*E05D 15/06* (2006.01)
*E05F 15/655* (2015.01)

(52) U.S. Cl.
CPC ..... *E05F 15/60* (2015.01); *E05D 15/063* (2013.01); *E05F 15/655* (2015.01); *E05Y 2201/46* (2013.01); *E05Y 2900/51* (2013.01)

(58) Field of Classification Search
CPC ..... E05Y 2900/132; E05Y 2201/46; B61D 19/005; B61D 19/02
See application file for complete search history.

(56) References Cited

U.S. PATENT DOCUMENTS 5,134,324 A * 7/1992 Sakagami ..... H02K 41/031 104/281
5,712,516 A * 1/1998 Kabout ..... H02K 41/031 310/12.04
6,449,905 B2 9/2002 Maki
6,742,631 B2 6/2004 Grundmann
6,832,449 B2 12/2004 Rennetaud et al.
7,019,421 B1 3/2006 Hall et al.
8,046,872 B2 * 11/2011 Burgess, III ..... E05D 15/0639 16/97
8,109,040 B2 * 2/2012 Finke ..... E05F 15/60 49/360
9,072,398 B2 7/2015 Choo et al.
10,577,844 B2 * 3/2020 Lam ..... E05D 15/0656
2001/0011439 A1 8/2001 Maki
2004/0255517 A1 12/2004 Inage
2008/0088188 A1 * 4/2008 Busch ..... E05F 15/60 310/68 B
2008/0100152 A1 * 5/2008 Busch ..... E05F 15/60 310/14
2008/0202860 A1 * 8/2008 Flynn ..... B66B 13/08 187/316
2008/0209813 A1 * 9/2008 Haab ..... E05D 15/0621 49/360
2010/0139037 A1 * 6/2010 Hufen ..... E05D 15/063 16/88
2014/0041304 A1 * 2/2014 Martin ..... E05D 15/0626 49/352

FOREIGN PATENT DOCUMENTS

CN 202450927 U 9/2012
CN 104832029 A 8/2015
DE 102004050342 B4 7/2007
DE 102005002038 B4 2/2009
EP 1122391 A2 8/2001
EP 1681425 A2 7/2006
EP 2476842 A2 7/2012
FR 2710366 A1 3/1995
JP H07-298599 A 11/1995
JP H11-196502 A 7/1999
JP 2001-288962 A 10/2001
JP 2004-015908 A 1/2004
RU 2144600 C1 1/2000
RU 2004113274 A 10/2005
SU 1638293 A1 3/1991
WO 2005/078754 A1 8/2005

* cited by examiner

DOOR ACTUATORS, INTEGRATED DOOR ACTUATOR AND METHOD OF OPERATING A DOOR ACTUATOR OF A TRANSIT VEHICLE

FIELD OF THE INVENTION

The present invention is to the field of transit vehicles including trains and the like, and more particularly to door actuators for repeatedly opening and closing doors of such transit vehicles.

BACKGROUND INFORMATION

Transit vehicles are generally provided with a door rail system being actuated by an actuator for opening and closing a door.

The door rail system is mounted to a car body of the transit vehicle adjacent the actuator. An example of a conventional actuator includes an endless screw assembly which can rotate about a rotation axis thereof. This conventional actuator converts rotary motion into linear motion using a carriage threadingly mounted to the endless screw assembly. By mechanically connecting the carriage of the conventional actuator with the door rail system, the linear motion can cause the door to move. In selecting an actuator system, one typically takes into consideration the factors of costs, durability, weight, volume (footprint), maintenance and power consumption.

Although the conventional use of the door rail system and of the actuator has been satisfactory to a certain degree, there remained room for improvement.

SUMMARY OF THE INVENTION

In accordance with an aspect, there is provided a door actuator comprising: a receiving structure having a door carriage path; a first coil assembly and a second coil assembly both being mounted to the receiving structure along a common coil assembly plane and being longitudinally spaced from one another along the door carriage path by a spacing distance; and a door carriage being slidingly received by the receiving structure, the door carriage having a plurality of alternate-pole magnets provided along a magnet plane being parallel and spaced apart from the coil assembly plane, the first and second coil assemblies being operable to move the door carriage back and forth between the two ends of the rail.

In accordance with another aspect, there is provided an integrated door actuator comprising: a receiving structure; a door carriage being trapped within the receiving structure and being linearly movable therealong; and a linear induction motor having a movable part mounted to the door carriage and a stationary part being mounted to the receiving structure, the linear induction motor being operable to move the door carriage back and forth along the receiving structure.

In accordance with another aspect, there is provided a method of operating a door actuator including a linear induction motor including first and second coil assemblies each having a plurality of coils and being mounted to a receiving structure of the door actuator, and a plurality of alternate-pole magnets being mounted to a door carriage being movably mounted to the receiving structure along the first and second coil assemblies, the method comprising the steps of: using a controller, from a rest position in which the coils of one of the first and second coil assemblies are faced by the plurality of alternate-pole magnets, activating all faced coils to electromagnetically engage the plurality of alternate-pole magnets and thereby accelerate the door carriage towards the other one of the first and second coil assemblies, the plurality of alternate-pole magnets progressively uncovering the coils as the door carriage is moved towards the other one of the first and second coil assemblies; and deactivating uncovered ones of the coils while simultaneously maintaining faced ones of the coils activated, as the door carriage moves towards the other one of the first and second coil assemblies.

In accordance with another aspect, there is provided a method of operating a door actuator including a linear induction motor including first and second coil assemblies each having a plurality of coils and being mounted to a receiving structure of the door actuator, and a plurality of alternate-pole magnets being mounted to a door carriage being movably mounted to the receiving structure along the first and second coil assemblies, the method comprising the steps of: using a controller, from an initial coil activation state in which some of the coils of one of the first and second coil assemblies are activated and the other ones of the coils of said assembly are deactivated, and during movement of the door carriage from the other one of the first and second coil assemblies to said assembly, activating the deactivated coils of said assembly while maintaining the activated coils of said assembly activated, to arrest the movement of said door carriage.

In accordance with another aspect, there is provided a method of operating a door actuator including a linear induction motor including first and second coil assemblies each having a plurality of coils and being mounted to a receiving structure of the door actuator, and a plurality of alternate-pole magnets being mounted to a door carriage being movably mounted to the receiving structure along the first and second coil assemblies, the method comprising the steps of: using a controller, from a state in which some of the coils of one of the first and second coil assemblies are faced by some of the plurality of alternate-pole magnets, activating the faced coils to electromagnetically engage the plurality of alternate-pole magnets and thereby at least one of accelerate a movement of the door carriage towards the other one of the first and second coil assemblies and decelerate a movement of the door carriage, the plurality of alternate-pole magnets progressively uncovering the coils as the door carriage moves; and deactivating uncovered ones of the coils while simultaneously maintaining faced ones of the coils activated.

In accordance with another aspect, there is provided a door actuator comprising: a linear induction motor including first and second coil assemblies being mounted to a receiving structure of the door actuator, and a plurality of alternate-pole magnets being mounted to a door carriage and being movably mounted to the receiving structure along the first and second coil assemblies; a power supply connected to at least one of the first and second coil assemblies; and a controller being connected to the power supply and being operable to, from a rest position in which the coils of one of the first and second coil assemblies are faced by the plurality of alternate-pole magnets, activate all faced coils to electromagnetically engage the plurality of alternate-pole magnets and thereby accelerate the door carriage towards the other one of the first and second coil assemblies, the plurality of alternate-pole magnets progressively uncovering the coils as the door carriage is moved towards the other one of the first and second coil assemblies; and deactivate uncovered ones of the coils while simultaneously maintaining faced ones of the coils activated, as the door carriage continues to move towards the other one of the first and second coil assemblies; and as the door carriage continues to move towards the other one of the first and second coil assemblies and the alternate-pole magnets progressively face coils of the other coil assembly, activate at least some of the coils of the other coil assembly to decelerate the movement of said door carriage. In some embodiments, said activating the inactivated ones is triggered by detecting that the door carriage has reached a threshold position along the receiving structure using at least one position detector. In some other embodiments, after said activating the at least some coils, the controller waits a given amount of time before performing said activating the inactivated ones of the coils. In further embodiments, said activating the inactivated ones of the coils is triggered when the door carriage has reached a given speed using at least one speed detector.

Many further features and combinations thereof concerning the present improvements will appear to those skilled in the art following a reading of the instant disclosure.

BRIEF DESCRIPTION OF THE DRAWINGS

FIG. 3 is an exploded view of an example of a coil assembly of the door actuator of FIG. 2.

DETAILED DESCRIPTION

Figure 1:
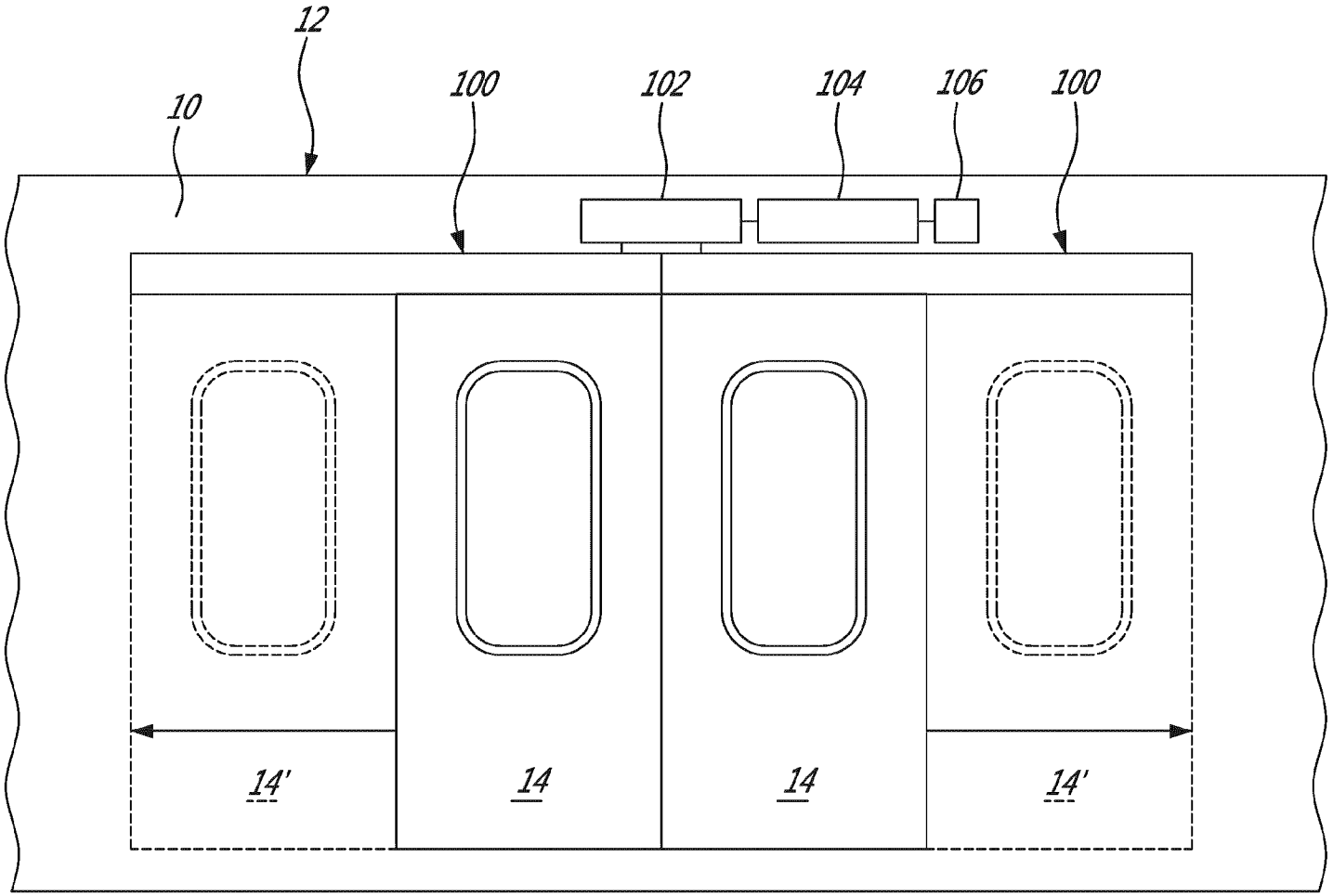
FIG. 1 is a schematic side view, fragmented, of a car body of a transit vehicle, showing a double door system with two door actuators, in accordance with an embodiment.

FIG. 1 shows a partial side view of the interior of a car body 10 of a transit vehicle 12, e.g., a train. As depicted, at some position along its side, the car body 10 has a double door system including two doors 14 that, when actuated by a respective one of two door actuators 100, can allow users to enter and/or exit the transit vehicle at a desired train station. As illustrated, the solid lines show the doors 14 in their respective closed position whereas the dashed lines show doors 14' in their respective open position. Some alternate embodiments can have a single door system instead of a double door system.

Figure 2:
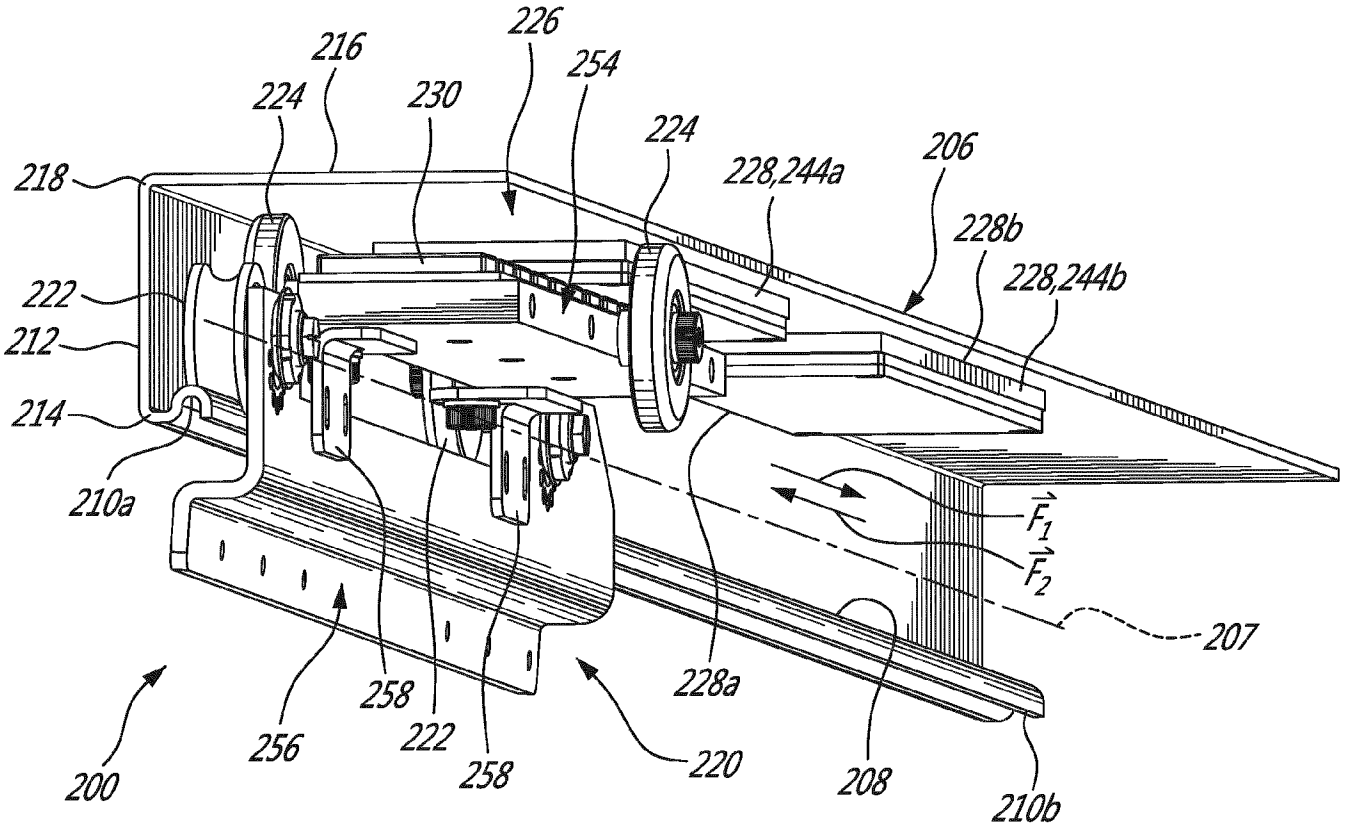
FIG. 2 is an oblique view of a first example of a door actuator, in accordance with an embodiment.

Referring particularly to FIG. 2, an example of a door actuator 200 is shown. As illustrated, the door actuator 200 includes a receiving structure 206, a door carriage 220 and a linear induction motor 226 as will be described below.

The receiving structure 206 has a rail 208 extending longitudinally between two ends 210*a* and 210*b* thereof. The receiving structure 206 can thus receive the door carriage 220 via the rail 208 in a manner that the door carriage 220 is longitudinally movable along a door carriage path 207.

In this example, the receiving structure 206 has a wall 212 which upwardly extends from a side 214 of the rail 208 and a hood 216 which extends perpendicularly from a top 218 of the wall 212 and over the rail 208. The receiving structure 206 can be made of a low magnetic permissibility material such as steel and it can be manufactured using cold forming. In another embodiment, the receiving structure 206 is made of a plurality of parts assembled to one another.

As depicted, the door carriage 220 is trapped within the receiving structure 206 and is linearly movable therealong. More specifically, the door carriage 220 is movably mounted to the rail 208 of the receiving structure 206 via a first plurality of guide rollers 222 ("first guide rollers 222"). The door carriage 220 is also movably mounted to the hood 216 of the receiving structure 206 via a second plurality of guide rollers 224 ("second guide rollers 224). In this embodiment, the door carriage 220 has a frame 254 to which a door hanger 256 is mounted using brackets 258.

To move the door carriage 220 back and forth between the two ends 210*a* and 210*b* of the rail 208, the door actuator 200 is provided with the linear induction motor 226. The linear induction motor 226 has a stationary part 228 which is mounted to the receiving structure 206 in a manner to extend parallel to the rail 208 and a movable part 230 which is mounted to frame 254 of the door carriage 220.

When the linear induction motor 226 is operated, an electromotive force is generated which causes the movable part 230, and thus the door carriage 220 to which it is mounted, to move along the receiving structure 206. As depicted, the electromotive force can be directed towards a first direction F1 along the receiving structure 206 or towards a second, opposite direction F2 depending on how the linear induction motor 226 is operated. As may be appreciated, when a door such as the door 14 shown in FIG. 1 is mounted to the door carriage 220, the door can be moved between the closed position and the open position upon operation of the linear induction motor 226.

Referring back to FIG. 1, the linear induction motor 226 can be operable via a power supply 102 and a controller 104 to move the door carriage 220 back and forth between the two ends 210*a* and 210*b* of the rail 208. During use, the controller can transmit one or more control signals (referred to as "the control signal") to the power supply which will operate the linear induction motor 226 based on the control signal. The power supply 102 can be a three-phase power inverter which converts direct current (DC) to alternating current (AC), and more especially three-phase AC. In this example, the two door actuators 100 are connected to the power supply 102 in a parallel circuit. Depending on the embodiment, the controller 104 is connected to the power supply 102 via a wired connector, a wireless connection, or a combination thereof. Power supply configured to provide DC or a single-phase AC current can also be used. The controller 104 can be in communication with a computer-readable memory 106 having stored thereon a suitable software to operate the power supply 102. The controller 104 can be provided in the form of a microcontroller, a processor and the like. The controller 104 can be in communication with a computer-readable memory storing data (e.g. control data), for instance.

Figure 2A:
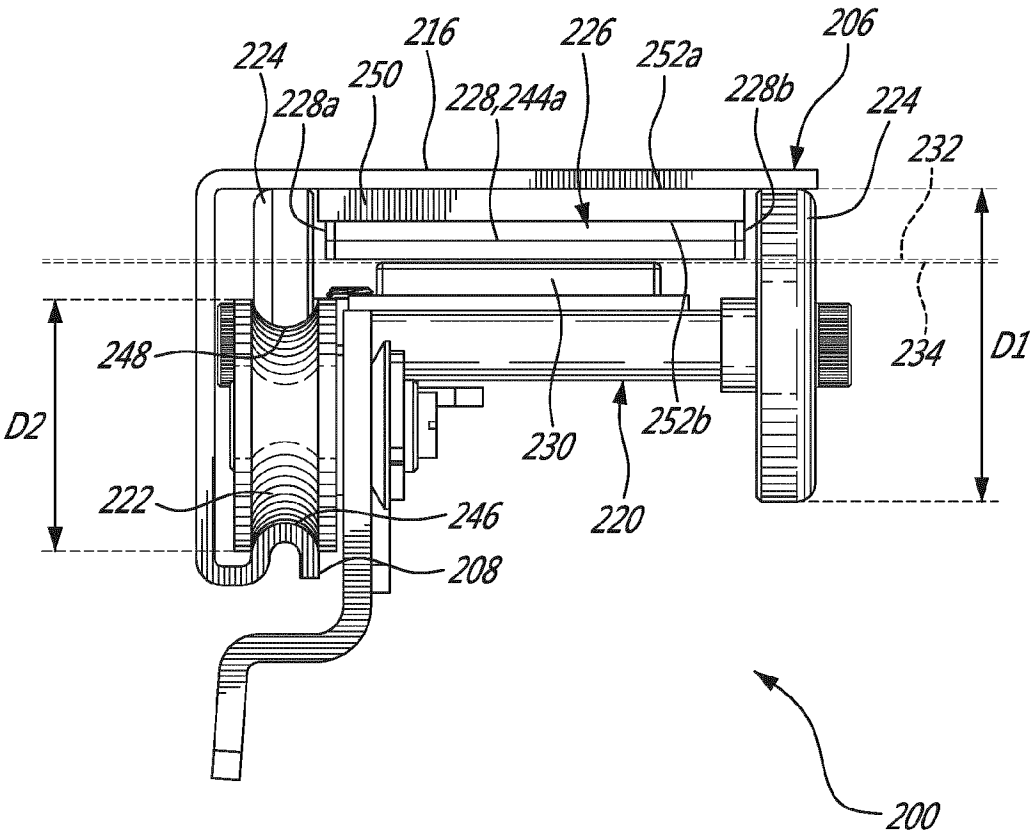
FIG. 2A is a front elevation view of the door actuator of FIG. 2.

Referring back to FIG. 2, the stationary part 228 of the linear induction motor 226 is mounted to the hood 216 of the receiving structure 206, and the second guide rollers 224 are movable along the stationary part 228 of the linear induction motor 226. As show, one second guide roller 224 is movable along a side of the stationary part 228 (distal from the wall 212) whereas two second guide rollers 224 are movable along another side of the stationary part 228 (proximate the wall 212) of the linear induction motor 226. It can thus be said that the second guide rollers 224 are movable along each side 228*a*, 228*b* of the stationary part 228, as best seen in FIG. 2A.

Using a total of three second guide rollers 224 in a 2×1 configuration can allow more resistance to twisting of the receiving structure 206 compared to a door carriage having four second guide rollers in a 2×2 configuration, for instance. As it will be understood, an example of a door actuator can have two, three, four or more than four second guide rollers depending on the circumstances. The number of first guide rollers may also depend on the application. Guide rollers and conventional parts may be purchased from Innovation for Entrance Systems (IFE).

The second guide rollers 224 are provided in the form of wheels each having a first diameter D1 which is larger than a second diameter D2 of the first guide rollers 222. In this embodiment, the second guide rollers 224 are configured to prevent upward movement of the door carriage 220 (towards the hood 212).

It was found that providing such second guide rollers 224 can allow to reduce wear and noise during use. Moreover, it was also found that providing such guide rollers 224 that run along each of the sides 228*a* and 228*b* of the stationary part 228 can reduce the need for precision associated with construction of the receiving structure 206. Also, it was found that when the movable part 230 upwardly faces the hood 216, dust is less likely to accumulate on the movable part 230 compared to an embodiment where the movable part 230 laterally faces the wall 212, for instance.

As depicted, the rail 208 has a convex guiding surface 246 whereas the first guide rollers 222 each have a concave surface 248 configured to mate with the convex guiding surface 246 of the rail 208. Similarly, the surface of the second guide rollers 224 has a shape configured to mate with a shape of the hood 216. In the illustrated embodiment, that shape is planar. In another embodiment, the second guide rollers have a concave surface, and the hood is provided with a corresponding convex guiding surface downwardly protruding from the hood to mate with the concave surface of the second guide rollers.

Referring back to FIG. 2, the stationary part 228 of the linear induction motor 226 is provided in the form of two spaced apart coil assemblies 244*a* and 244*b*. Each coil assembly 244*a*, 244*b* is disposed proximate a respective one of the two ends 210*a* and 210*b* of the rail 208 of the receiving structure 206. Correspondingly, the movable part 230 of the linear induction motor 226 is provided in the form of a series of alternate-pole magnets 242.

FIG. 2A shows that each coil assembly 244*a*, 244*b* is indirectly mounted to the hood 216 via a back plate 250 made of a ferromagnetic material, such as iron. As illustrated, the back plate 250 has a first face 252*a* mounted to the receiving structure 206 and a second face 252*b* mounted to the corresponding one of the coil assemblies 244*a*, 244*b*. In an embodiment, the back plate may have an antirust treatment.

The stationary part 228 generally defines a first plane 232 whereas the movable part 230 generally defines a second plane 234 parallel to the first plane 232 but slightly offset therefrom. In other words, the stationary part 228 is placed in proximity with the movable part 230 and they are both embedded to the receiving structure 206. In some embodiments, the first and second planes 232 and 234 may be separated by a fraction of an inch. More specifically, in this exemplary configuration, the first plane 232 of the stationary part 228 and the second plane 234 of the movable part 230 can be referred to as the "coil assembly plane 232" and the "magnet plane 234", respectively. It will be understood that, in some other embodiments, the stationary part can include a series of alternate-pole magnets longitudinally distributed along the rail of the receiving structure and that the movable part can include a series of longitudinally spaced apart coils. In some other embodiments, the stationary part can have a single coil assembly extending along the receiving structure.

An exploded view of the coil assembly 244*a* is provided in FIG. 3. As depicted, the coil assembly includes a series of coils 240 longitudinally spaced from one another. More specifically, the coil assembly 244*a* has a coil casing 272 and a series of longitudinally spaced apart coils 240 received in the coil casing 272. In this example, the series of coils 240 has two coil triplets 274 or six longitudinally spaced apart coils 240. In this case, the coil casing 272 can be made of plastic, e.g., epoxy. As depicted, the coil assembly 244*a* has seats 276 for snugly receiving the coils 240 and a power supply cable channel 278 for snugly receiving a power supply cable to be connected between the power supply and the coil assembly 244*a*. The coil casing 272 is configured to snugly receive the components so that they do not move during use.

As can be understood, when one of the coils 240 is powered by the power supply, the powered coil 240 becomes an electromagnet wherein each face thereof is characterized by either a south pole or a north pole, depending on the direction in which current flows through the powered coil 240. By doing so, each coil 240 is powered so as to attract one of the magnets 242 or repel another one of the magnets 242 in a way that can cause the door carriage 220 to move in a desired direction.

The door actuator can be provided with one or more position sensors (referred to as "the position sensor") in communication (wired and/or wireless) with the controller to detect the position of the movable part of the linear induction motor in a quasi-instantaneous manner. The position sensor can be provided as part of the movable part or the stationary part, or a combination thereof. For instance, a position sensor 280 is provided as part of the coil assembly 244*a*. More specifically, the position sensor 280 is snugly received into the coil casing 272. In this example, the position sensor 280 is used to detect the magnets 242 when the magnets 242 pass in proximity with the position sensor 280 to determine the position of the door carriage 220 during use. In this example, the position sensor 280 is solid state and contactless.

Figure 4:
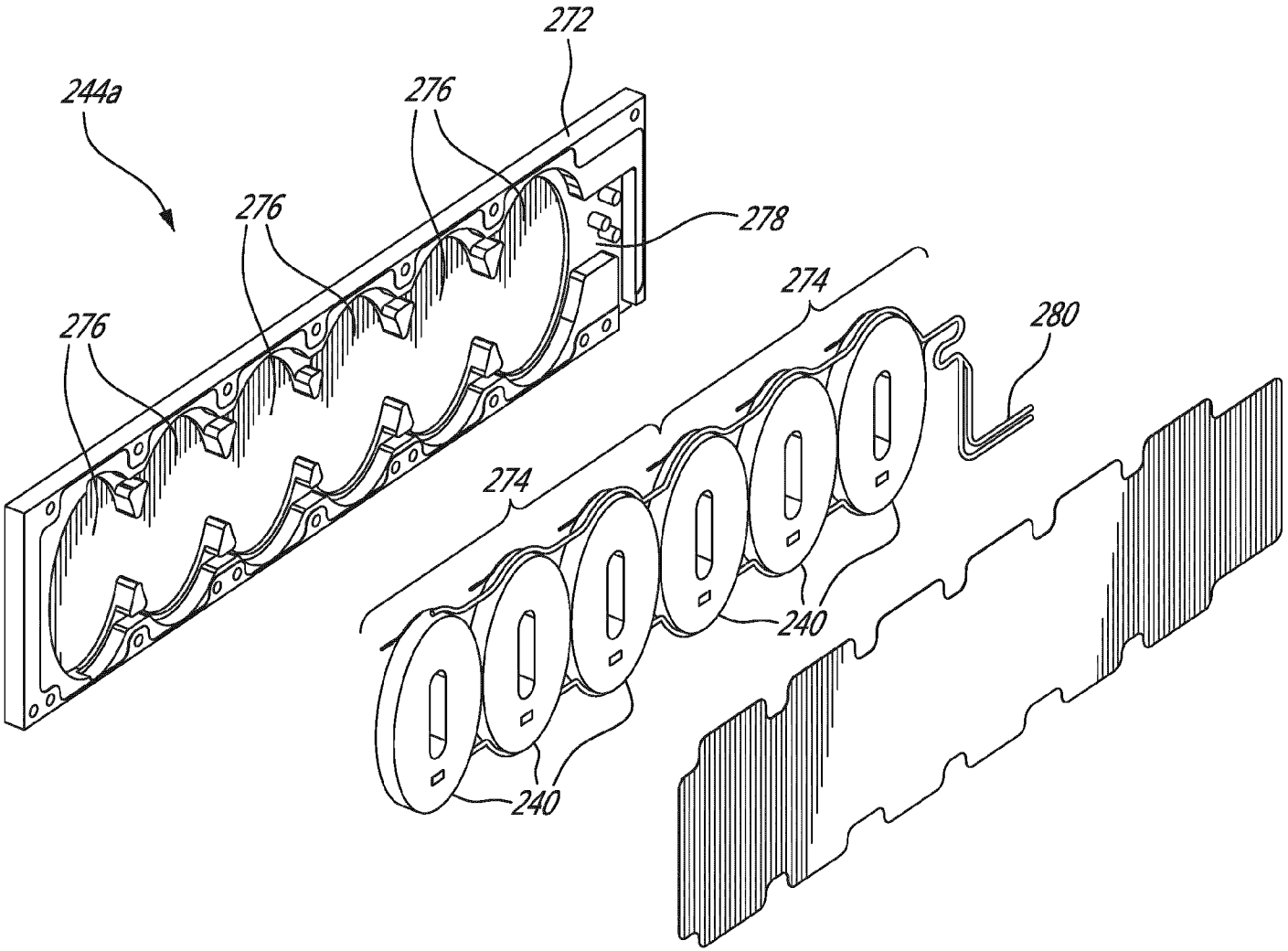
FIG. 4 is an oblique view of an example of a door carriage of the door actuator of FIG. 2.
Figure 4:
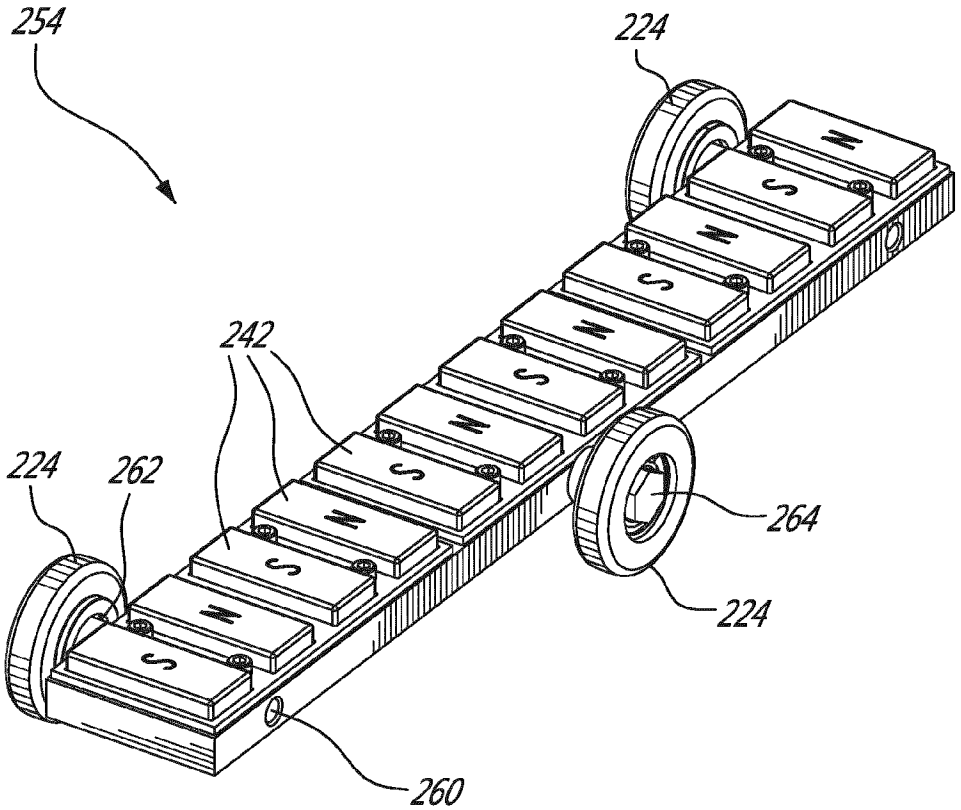

FIG. 4 shows an oblique view of an example of the frame 254, in accordance with an embodiment. As it can be seen, the frame 254 has three second guide rollers 224 rotatably mounted thereto via, for instance, axle bores 260, bearings 262 and nut 264. As mentioned above, in this example, the movable part of the linear induction motor is provided in the form of the series of alternate-pole magnets 242. For clarity, upward faces of the magnets are identified with either "N", which stands for "north pole", or "S", which stands for "south pole".

Figure 5:
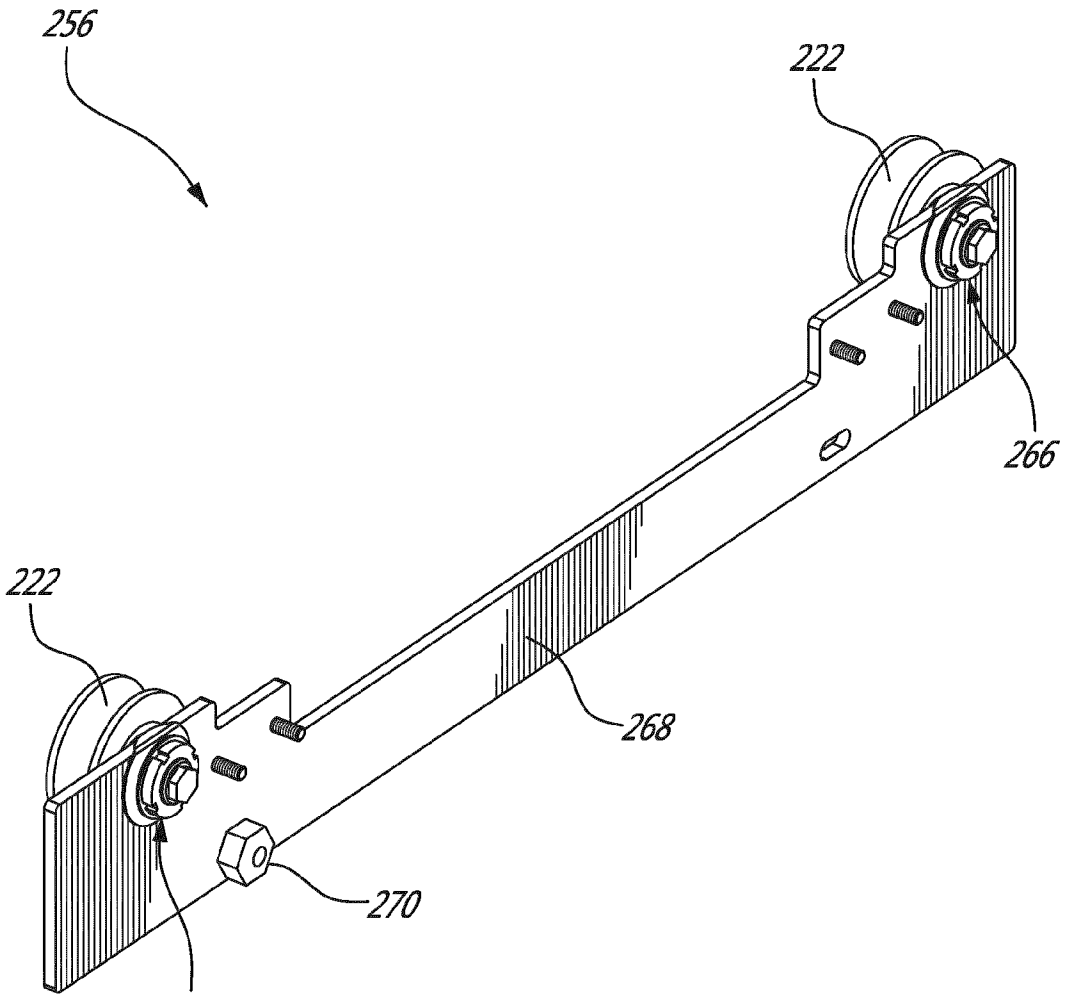
FIG. 5 is an oblique view of an example of a door hanger of the door actuator of FIG. 2.

FIG. 5 shows an oblique view of an example of the door hanger 256, in accordance with an embodiment. As illustrated, the door hanger 256 has two first guide rollers 222 rotatably mounted thereto via axle bores, bearings and nuts 266. The door hanger 256 has a door mounting surface 268 which is adapted to be mounted to a door of the transit vehicle during use. The shape of the door hanger can vary to mate with a shape of a door of a transit vehicle. The door hanger 256 may be provided with one or more eccentric nuts 270 to adjust the height of the door that is mounted to the door hanger 256.

As it will be described herebelow, other embodiments of a linear induction motor are possible. As shown in the embodiments presented in FIGS. 6, 7 and 8, the stationary part of the linear induction motor can be mounted to the wall of the receiving structure instead of being mounted to the hood. Therefore, instead of having a coil plane and a magnet plane which are parallel to the hood of the receiving structure (i.e. horizontal when referring to the embodiment of FIG. 2), the coil plane and the magnet plane can be parallel to the wall of the receiving structure (i.e. vertical when referring to the embodiments of FIGS. 6, 7 and 8). In an alternate embodiment, the coil plane and the magnet plane can be parallel to the hood but in proximity with the rail of the receiving structure.

Figure 6A:
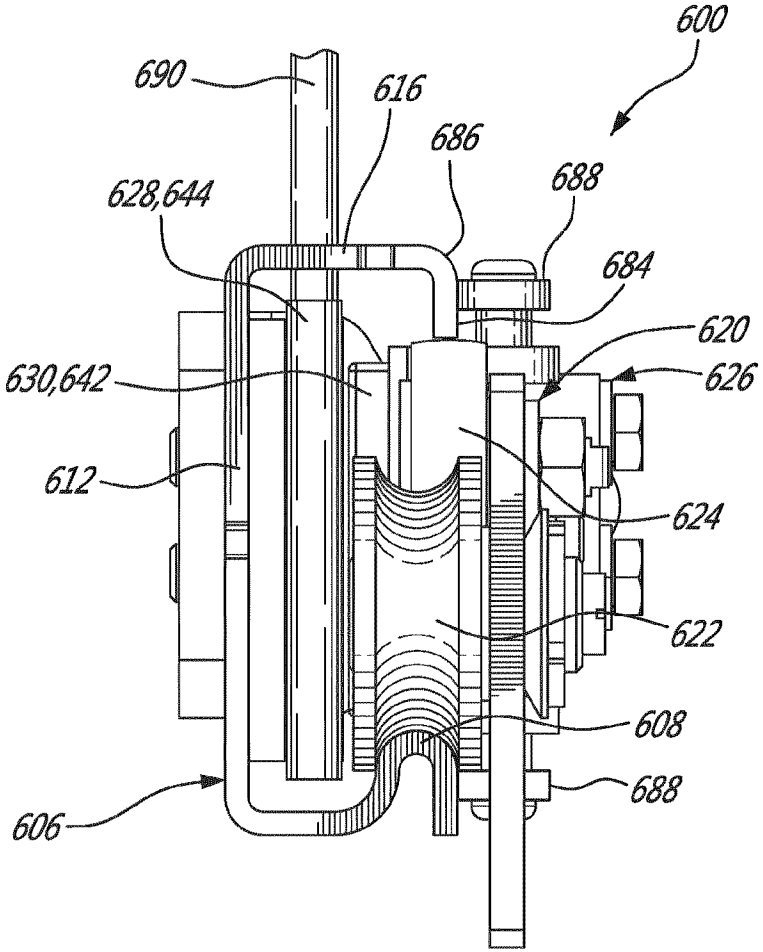
FIG. 6A is a front elevation view of the door actuator of FIG. 6.
Figure 6:
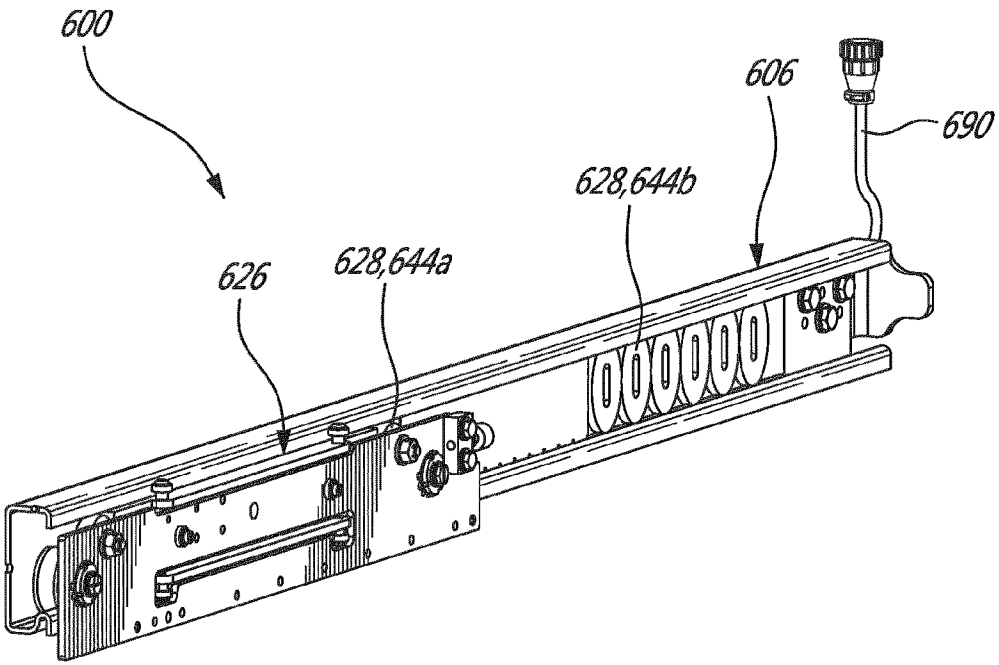
FIG. 6 is an oblique view of a second example of a door actuator, in accordance with an embodiment.

For instance, FIG. 6 shows an oblique view of an example of a door actuator 600 whereas FIG. 6A shows a front elevation view of same. Like elements will bear like reference numerals, but in the 600 series instead of in the 200 series. Referring to FIGS. 6 and 6A, the door actuator 600 has the receiving structure 606 to which is mounted the linear induction motor 626.

As best shown in FIG. 6A, the stationary part 628 (associated coil assemblies 644*a* and 644*b*) is mounted to the wall 612 of the receiving structure 606. Accordingly, the movable part 630 (associated magnets 642) is mounted to the door carriage 620 which is parallel to the wall 612 of the receiving structure 606. As shown, the hood 616 has a lip 684 which extends from a side 686 of the hood 616 opposite that of the wall 612 and towards the rail 608. In this case, the second guide rollers 624 are movably mounted to the lip 684 of the hood 616.

An optional third plurality of guide rollers 688 (referred to as "third guide rollers 688") is provided to the door carriage 620 and are movably mounted to exterior surfaces of the lip 684 and of the rail 608. The third guide rollers 688 have a rotation axis perpendicular to that of the first and second guide rollers 622 and 624 and help maintain the door carriage 620 in position during use thereof.

As it can be seen in both FIGS. 6 and 6A, the door actuator 600 has a power supply cable 690 connected to the coil assemblies 644*a* and 644*b*. As shown, this example of the door actuator 600 has an additional set of guide rollers compared with the embodiment shown in FIGS. 2 and 2A.

Figure 7:
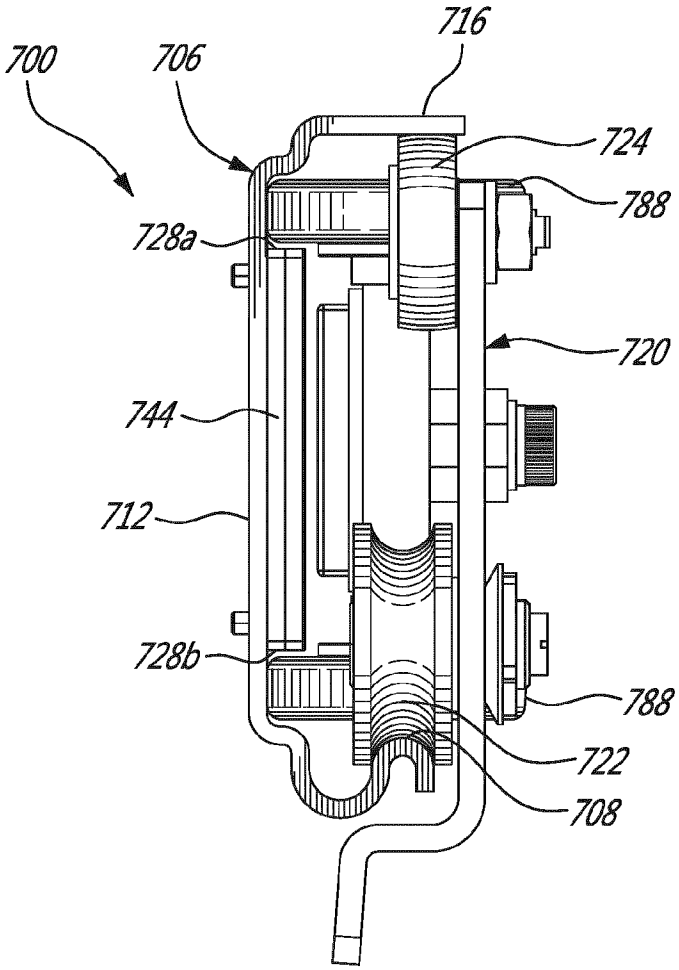
FIG. 7 is a front elevation view of a third example of a door actuator, in accordance with an embodiment.

FIG. 7 shows a front elevation view of an example of a door actuator 700, in accordance with another embodiment. Like elements will bear like reference numerals, but in the 700 series instead of in the 200 and/or 600 series. As shown, the door actuator 700 has the first guide rollers 722 which are movably mounted to the rail 708, the second guide rollers 724 which are movably mounted to the hood 716 of the receiving structure 706 and the third guide rollers 788 which are, in this embodiment, movably mounted to the wall 712 of the receiving structure 706.

As will be understood, the construction of the door carriage 720 is similar to that of the door carriage 220 since the third guide rollers 788 are provided along each side 728*a*, 728*b* of the coil assemblies 744. As shown, the third guide rollers 788 are provided in the form of wheels with a larger diameter relative to a diameter of the first and second guide rollers 722 and 724.

Figure 8:
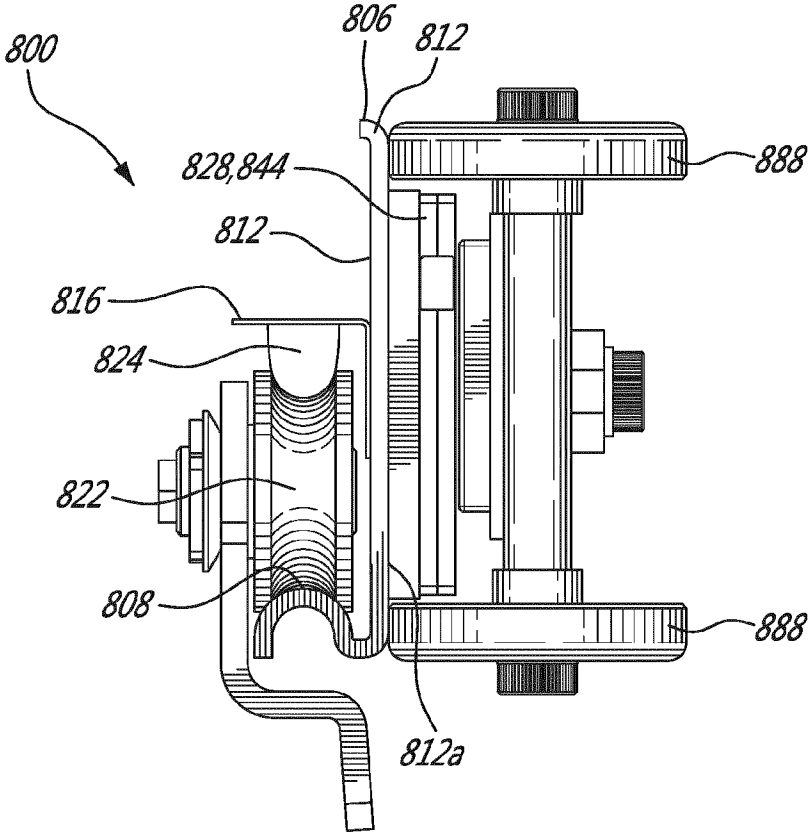
FIG. 8 is a front elevation view of a fourth example of a door actuator, in accordance with an embodiment.

FIG. 8 shows a front elevation view of an example of a door actuator 800, in accordance with another embodiment. Like elements will bear like reference numerals, but in the 800 series instead of in the 200, 600 and/or 700 series. In this embodiment, the stationary part 828, provided in the form of coil assembly 844, is mounted to a face 812*a* of the wall 812 facing away from the rail 808 of the receiving structure 806. Similarly to the door actuator 700, the door actuator 800 has the first guide rollers 822 which are movably mounted to the rail 808, the second guide rollers 824 which are movably mounted to the hood 816 of the receiving structure 806 and the third guide rollers 888 which are, in this embodiment, movably mounted to the wall 812 of the receiving structure 806. This embodiment represents a preliminary prototype of another exemplary configuration of a door actuator. It will be understood that, in an advanced version of this prototype, a mechanical coupling part can be provided between the door carriage 820 and the door hanger 856.

It was also found desirable that the door actuator limits its power consumption and more specifically the peak power drawn when opening or closing a door.

Based on this, a method of operating the door actuator is presented herein in which the power requirements can be substantially constant until the linear induction motor slows down the door at the end of its travel. As will be understood, the method of operating can be performed using the door actuator shown, for instance, in FIG. 2. With reference to this embodiment and to FIGS. 9A-E, the door actuator 200 can have a linear induction motor including the first and second coil assemblies 244*a* and 244*b* longitudinally spaced apart from one another. Each of the first and second coil assemblies 244*a* and 244*b* has two coil triplets 274*a*, 274*b* (i.e. a total of six coils 240) longitudinally spaced apart from one another.

Figure 9A:
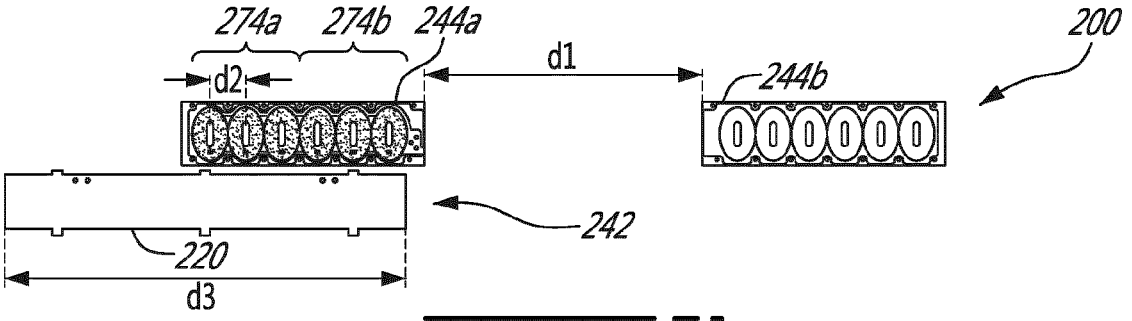
FIGS. 9A, 9B, 9C, 9D, and—9E are schematic views showing a movable part of a linear induction motor at a plurality of positions relative to two spaced-apart coil assemblies, in accordance with an embodiment.
Figure 9B:
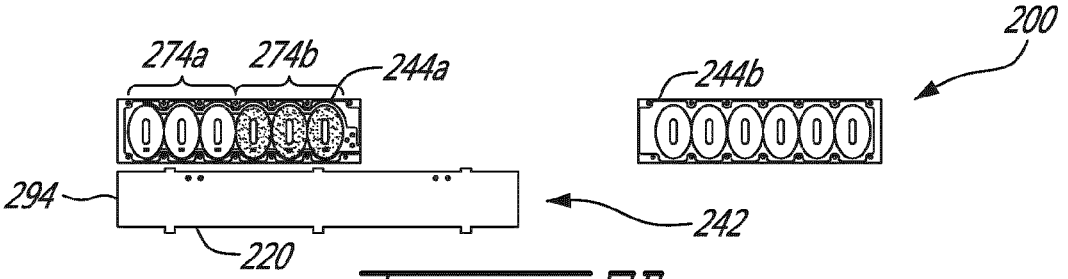

The method of operating the door actuator 200 is schematically illustrated in FIGS. 9A-9E wherein each of the figures shows the plurality of alternate-pole magnets 242 moved via the door carriage 220 at different times while the method is being performed. As it can be seen in FIG. 9A, one can define a spacing distance d1 between the two longitudinally spaced apart coil assemblies 244*a* and 244*b*, an inter-coil spacing distance d2 between adjacent coils of a same coil assembly and a length d3 of the plurality of alternate-pole magnets 242.

in FIG. 9A, the method includes a step of, from a rest position in which the coils of the first coil assembly 244*a* are faced by the plurality of alternate-pole magnets 242 of the door carriage 220, activating all faced coils to electromagnetically engage the plurality of alternate-pole magnets 242 and thereby accelerate the door carriage 220 towards the second coil assembly 244*b*. It can be understood that the plurality of alternate-pole magnets 242 progressively uncover the coils of the first coil assembly 244*a* as the door carriage 220 is moved towards the second coil assembly 244*b*. In FIG. 9B, the leftmost one of the coils of the first coil assembly 244*a* is about to be uncovered by the plurality of alternate-pole magnets 242 as the door carriage 220 moves to the right. Still referring to FIG. 9B, the method also includes a step of deactivating uncovered ones of the coils (the leftmost coils) while simultaneously maintaining faced ones of the coils (the right most coils) activated, as the door carriage 220 moves towards the second coil assembly 244*b*. As it will be understood, the method can be performed in an opposite direction, to accelerate the plurality of alternate-pole magnets 242 from the second coil assembly 244*b* towards the first coil assembly 244*a*, in which case the rest position is shown in FIG. 9E.

Figure 9C:
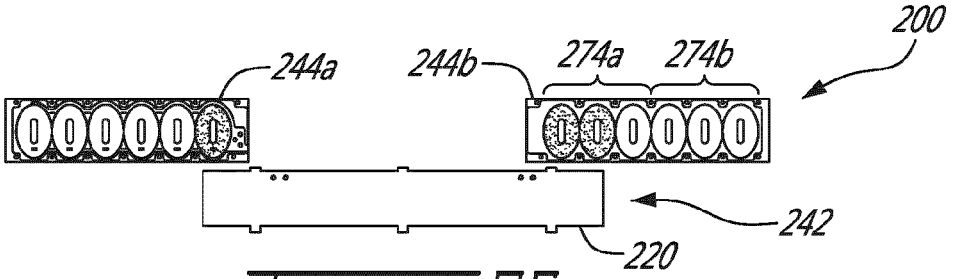
Figure 9D:
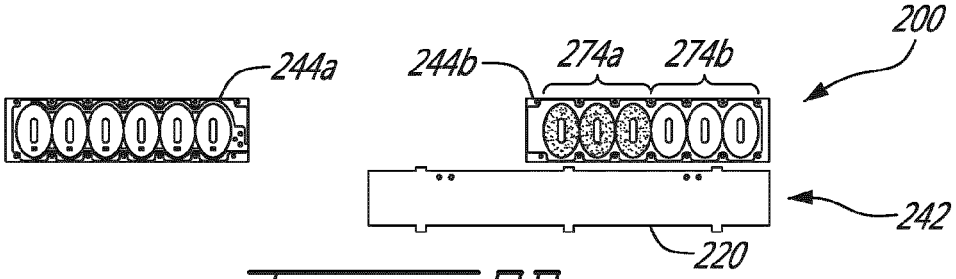
Figure 9E:
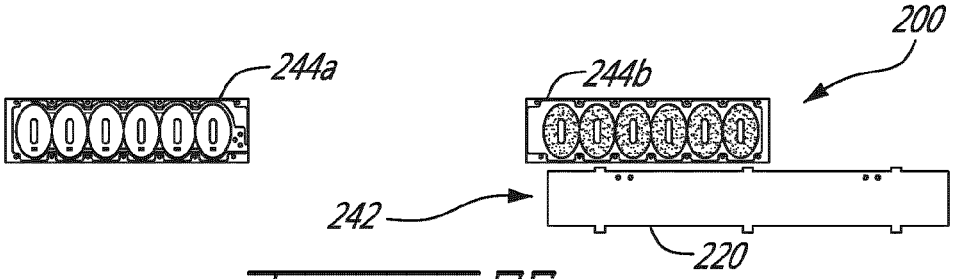

In FIGS. 9C and 9D, the method includes a step of, from an initial coil activation state in which some of the coils of the second coil assembly 244*b* are activated and the other ones of the coils of the second coil assembly 244*b* are deactivated, and during movement of the door carriage 220 from the first coil assembly 244*a* to the second coil assembly 244*b*, a step of activating the deactivated coils of the second coil assembly 244*b* while maintaining the activated coils of the second coil assembly 244*b* activated in order to arrest the movement of said door carriage 220. The initial coil activation state refers to any combination of activated coils which can cause the door carriage 220 to move. It is contemplated that the method can be performed in an opposite direction wherein the first coil assembly 244*a* is used to arrest the movement of the door carriage 220 that is incoming from the second coil assembly 244*b*.

As it will be understood by the skilled reader, the step of activating all coils of a given coil assembly can encompass a step of powering the coils of the given coil assembly in a given (e.g., sequential) manner to cause the door carriage to move in a desired direction.

An embodiment of a method of operating the door actuator 200 will now be detailed. For instance, referring now to FIG. 9A, the plurality of alternate-pole magnets 242 are shown facing the first coil assembly 244*a*. At this stage, the method has a step of activating (i.e. powering in accordance with a given sequential powering using a power supply) all faced coils, i.e. the two coil triplets 274, 274*b* of the first coil assembly 244*a*, to accelerate the door carriage 220 towards the second coil assembly 244*b*. As will be understood, the electromotive force generated by the linear induction motor in this example is directed to the right when referring to FIGS. 9A-E. In these figures, empty circles are meant to refer to deactivated coils whereas shadowed circles are meant to refer to activated coils. As mentioned above, activated coils are not necessarily powered at all times, depending on the sequential powering of the activated coils.

As shown in FIG. 9B, the method has a step of deactivating uncovered coils of the first coil assembly 244*a*, i.e. the coil triplet 274*a* which is to be first left behind by a trailing edge 294 of the door carriage 220.

Broadly described, this method favors activation of the coils that face the magnets (i.e. faced coils), and preferably, only the coils that can create a sufficient electromotive force on the magnets. Moreover, it was found that maintaining activation of coils that no longer face the magnets (i.e. uncovered coils) did not create an induced voltage resulting from the electromotive force. Therefore, the uncovered coils, when still activated, consume more power than the faced coils which do have an induced force proportional to the speed of the motor.

Accordingly, the latter design can allow to lower the peak power consumed by the door actuator. Despite that the total amount of energy consumed by the door actuator in an opening/closing cycle is negligible in practice, the peak power that a device consumes defines the size of its cables (thus its weight and its cost) and the size of the power supply inside the car body. Since the peak power is reached during the acceleration of the door carriage, deactivating some less useful coils helps reducing the peak power that will be consumed by the door actuator, and thus limits its size, its weight and its costs.

In an embodiment, the step of deactivating is triggered by detecting that the door carriage has reached a threshold position along the receiving structure using a position detector. In another embodiment, the step of deactivating is performed once a given amount of time has been elapsed since the beginning of the step of activating. In other words, after said activating, the methods includes waiting a given amount of time before performing said deactivating. In a further embodiment, the step of deactivating is triggered when the door carriage has reached a given speed using at least one speed detector.

FIG. 9C shows the door carriage 220 as it travels from the first coil assembly 244*a* towards the second coil assembly 244*b*. In this case, one coil is activated in the first coil assembly 244*a* while two coils are activated in the second coil assembly 244*b*. Indeed, as it will be understood, in this embodiment, the number of coils that are to be activated at a same time is a multiple of three due to the three-phase AC that is used to power the linear induction motor.

As shown in FIG. 9D, the decelerating phase resembles the accelerating phase. For instance, in this case, only one of the two coil triplets 274*a* and 274*b* of the second coil assembly 244*b* is activated to start the deceleration of the plurality of alternate-pole magnets 242 as they arrive from the first coil assembly 244*a*, i.e. the coil triplet 274*a* of the second coil assembly 244*b*.

FIG. 9E shows that the two coil triplets 274*a* and 274*b* of the second coil assembly 244*b* are activated until the door carriage 220 is stopped.

Knowing that the electromotive force depends on the strength of the magnetic field imparted by the coils, the number of turns and of the current that flows through the coils, it was found that if an electromotive force F can be obtained with a current I in one coil, a same force F with a current I/2 can be obtained in two coils. Reducing the current by a factor two can reduce the loss in the copper of a coil by a factor four. Considering that two coils are activated instead of one, the total loss can be divided by a factor two. This means that an electromotive force two times stronger is obtained using a same power during the accelerating phase of the method. The gain that is obtained by activating two coils instead of one reduces with the acceleration of the door carriage; a phenomenon due to the induced tension created by the electromotive force. Having six activated coils during the acceleration phase of the method allows to increase the efficiency during the acceleration phase. However, once the acceleration is over, only three coils are deactivated because the gain due to this additional three coils was limited due to the speed of the door carriage and the electromotive force. It is also noted that limiting the number of coils can reduce the weight of the door actuator and also reduce its costs.

It is understood that the two coil assemblies 244*a* and 244*b* are longitudinally spaced by the spacing distance d1 which is greater than the inter-coil spacing distance d2 defined as the distance between two coils of a common coil assembly and equal or smaller than the length d3 of the door carriage 220.

The lengths of the parts of the door actuator can vary from an embodiment to another. For instance, in an embodiment, the coil assemblies 244*a* and 244*b* each have a length of 12 inches and are characterized by a spacing distance d1 of 12 inches, and the door carriage 220 has a length d3 of 18 inches. In another embodiment, the coil assemblies 244*a* and 244*b* each have a length of 6 inches and are characterized by a spacing distance d1 of 6 inches, and the door carriage 220 has a length d3 of 18 inches. Indeed, in such an embodiment, providing the spacing distance d1 between the two coil assemblies 244*a* and 244*b* can save the costs and the weight associated to one complete coil assembly (e.g., 6 coils) relative to conventional linear actuators which have a continuous longitudinal array of coils.

Figure 10:
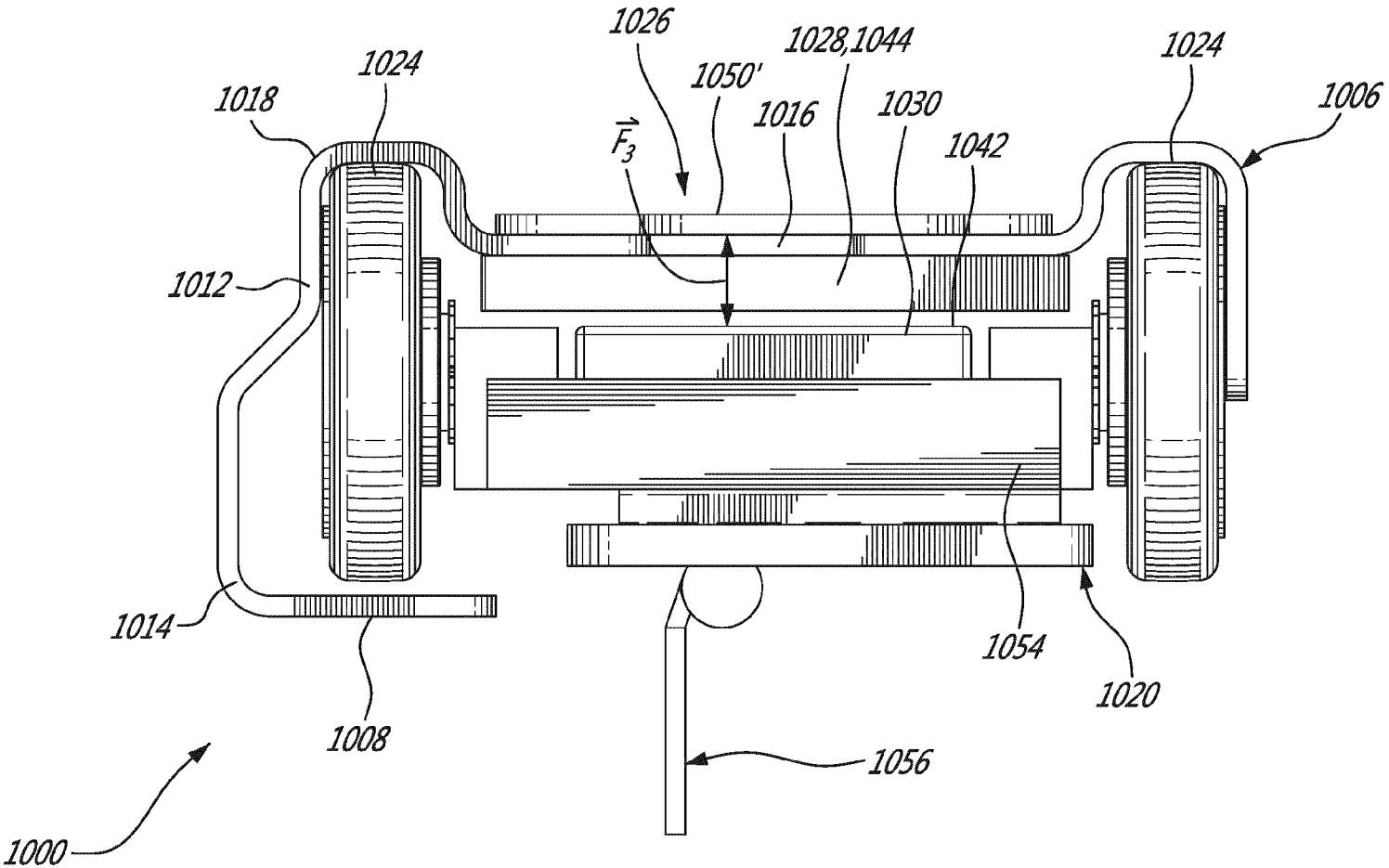
FIG. 10 is a front elevation view of a fifth example of a door actuator, in accordance with an embodiment.

FIG. 10 shows a front elevation view of another example of a door actuator 1000, in accordance with an embodiment. Like elements will bear like reference numerals, but in the 1000 series instead of in the 200, 600, 700 and/or 800 series. In this embodiment, the receiving structure 1006 has a wall 1012 extending longitudinally between two ends thereof and a hood 1016 extending from a top 1018 of the wall 1012. As in other embodiments, the linear induction motor 1026 includes a stationary part 1028 and a movable part 1030. The stationary part 1028 is mounted to a side of the hood 1016 and is provided in the form of coil assembly 1044. The movable part 1030 is mounted to the frame 1054 of the door carriage 1020 and is provided in the form of a plurality of magnets 1042. The door carriage 1020 has a door hanger 1056 mounted on the frame 1054 thereof. In this embodiment, the frame 1054 of the door carriage 1020 is movably mounted to the hood 1016 of the receiving structure 1006 via a first plurality of guide rollers 1024 (referred to as "the first guide rollers 1024"). The receiving structure 1006 includes a back plate 1050' of ferromagnetic material mounted to the hood 1016 and behind the stationary part 1028. In this way, the coil assembly 1044 is between the plurality of magnets 1042 and the back plate 1050'. During use, the first guide rollers 1024 of the door carriage 1020 are maintained against the hood 1016 via a magnetic attraction (see force F3) between the plurality of magnets 1042 and the back plate 1050' of ferromagnetic material. In some embodiments, the magnetic attraction can sustain a weight of 400 Lbs. Additionally, the receiving structure 1006 can have a rail 1008 extending away from a side 1014 of the wall 1012 in direction of the door carriage 1020. The rail 1008 can provide support to at least some of the first guide rollers 1014 in case the magnetic attraction is overcome by a greater force in opposite direction.

As can be understood, the examples described above and illustrated are intended to be exemplary only. For instance, the door actuator can be used in vehicles (e.g. transit vehicles) and in buildings. In another embodiment, the receiving structure is made of a plurality of parts assembled to one another. The receiving structure can have at least one open end adapted for receiving the door carriage. In an alternate embodiment, each door actuator has its own power supply and its own controller. As it will be understood, when two elements are said to be mounted to one another, it is meant to encompass, for instance, two elements being fastened to one another or alternatively two elements being made integral to one another. The scope is indicated by the appended claims.

What is claimed is:

1. A door actuator, comprising:

a receiving structure having a door carriage path;

a first coil assembly and a second coil assembly, both being mounted to the receiving structure along a common coil assembly plane and being longitudinally spaced from one another along the door carriage path by a spacing distance; and a door carriage being slidingly received by the receiving structure, the door carriage having a plurality of alternate-pole magnets provided along a magnet plane being parallel and spaced apart from the coil assembly plane, the first and second coil assemblies being operable to move the door carriage back and forth between the two ends of the rail;

wherein the first and second coil assemblies are operable, from a rest position in which the coils of one of the first and second coil assemblies are faced by the plurality of alternate-pole magnets, to activate all faced coils of the first and second coil assemblies to electromagnetically engage the plurality of alternate-pole magnets and accelerate the door carriage towards the other one of the first and second coil assemblies, the plurality of alternate-pole magnets progressively uncovering the coils of the first and second coil assemblies as the door carriage is moved towards the other one of the first and second coil assemblies, and to deactivate ones of the coils of the first and second coil assemblies, which have been uncovered by the door carriage, while simultaneously maintaining activation of faced ones of the coils of the first and second coil assemblies, as the door carriage continues to move towards the other one of the first and second coil assemblies; and as the door carriage continues to move towards the other one of the first and second coil assemblies and the alternate-pole magnets progressively face coils of the other one of the first and second coil assemblies, activate at least some of the coils of the other one of the first and second coil assemblies to decelerate the movement of the door carriage.

2. The door actuator of claim 1, wherein the spacing distance is at least one of equal and smaller than a length of the door carriage.

3. The door actuator of claim 1, wherein the spacing distance is at least six inches.

4. The door actuator of claim 1, wherein a length of the door carriage is about 18 inches.

5. The door actuator of claim 1, wherein each of the first and second coil assemblies has a coil casing and a plurality of longitudinally spaced apart coils received in the coil casing.

6. The door actuator of claim 5, wherein an inter-coil spacing distance between two adjacent ones of the longitudinally spaced apart coils of a respective one of the first and second coil assemblies is smaller than the spacing distance between the first and second coil assemblies.

7. The door actuator of claim 5, wherein the plurality of longitudinally spaced apart coils of each of the first and second coil assemblies is six longitudinally spaced apart coils.

8. The door actuator of claim 5, wherein the coil casing is made of a plastic material.

9. The door actuator of claim 5, wherein each of the first and second coil assemblies has a back plate having a first face mounted to the receiving structure and a second face mounted to the coil casing.

10. The door actuator of claim 5, wherein the coil casing has a power supply cable channel for receiving a power supply cable connected between a power supply and the first and second coil assemblies.

11. The door actuator of claim 5, wherein the coil casing has a length of about 12 inches.

12. The door actuator of claim 1, wherein the door carriage includes a frame and a plurality of wheels being rotatably mounted to the frame and movably mounted to at least one of a wall and a hood of the receiving structure.

13. The door actuator of claim 12, wherein the plurality of wheels include three wheels.

14. The door actuator of claim 1, wherein the door carriage includes a frame to which are mounted the plurality of alternate-pole magnets and a door hanger mounted to the frame.

15. The door actuator of claim 1, wherein the plurality of alternate-pole magnets includes twelve magnets.

16. The door actuator of claim 1, wherein the receiving structure is made of a magnetic permissibility material.

* * * * *